US006196673B1

(12) United States Patent
Takahashi

(10) Patent No.: US 6,196,673 B1
(45) Date of Patent: Mar. 6, 2001

(54) INK-JET RECORDING DEVICE

(75) Inventor: Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/054,398

(22) Filed: Apr. 3, 1998

(30) Foreign Application Priority Data

Apr. 4, 1997 (JP) ..... 9-102783

(51) Int. Cl.[7] ..... B41J 2/175
(52) U.S. Cl. ..... 347/93
(58) Field of Search ..... 347/85, 86, 87, 347/93, 92

(56) References Cited

U.S. PATENT DOCUMENTS 5,621,446 * 4/1997 Tanaka et al. ..... 347/85

FOREIGN PATENT DOCUMENTS 441458 8/1991 (EP) .
444654 9/1991 (EP) .
574888 12/1993 (EP) .
609863 8/1994 (EP) .
712727 5/1996 (EP) .
869 006 * 10/1998 (EP) .
63-118260 5/1988 (JP) ..... B41J/3/04
4-110157 4/1992 (JP) ..... B41J/2/175

OTHER PUBLICATIONS

Patent Abstracts of Japan, vol. 008, No. 132, Jun. 20, 1984, JP 59–033153.

* cited by examiner

*Primary Examiner*—N. Le
*Assistant Examiner*—Michael Nghiem
(74) *Attorney, Agent, or Firm*—Sughrue, Mion, Zinn, Macpeak & Seas, PLLC

(57) ABSTRACT

A porous material is used to fill a portion of an ink supply path extending from a needle tip to a filter. Ink is conveyed across the porous material to the filter and wets the entire top surface of the filter. The porous material reduces the substantial cross sectional area of the bubbles that pass therethrough so that the bubbles are then permitted to pass through the filter. Because the bubbles pass through the filter, the stagnation of bubbles on a filter at the end of an ink supply needle is prevented.

19 Claims, 3 Drawing Sheets

INK-JET RECORDING DEVICE

BACKGROUND OF THE INVENTION

1. Field of the Invention

The present invention generally relates to an ink-jet recording apparatus that comprises a recording head, for ejecting ink droplets from nozzle openings in response to print signals, and an ink cartridge for supplying ink to the recording head.

2. Description of the Related Art

In an ink-jet recording apparatus, which includes a recording head and an ink cartridge for supplying ink to the recording head, an ink supply needle is provided on the recording head and is inserted into and removed from an ink supply port that is formed in the ink cartridge. This arrangement facilitates the supply of ink from the ink cartridge to the recording head.

In FIG. 5 is shown an example of structure in the vicinity of an ink supply needle A. An open portion in an area connecting an ink supply port in needle A to an ink flow path B, which communicates with the recording head, is expanded to form a filter chamber C. A filter D fabricated of unwoven cloth or a mesh material is provided in chamber C. Bubbles which are generated or expanded in the ink cartridge, and dust, are prevented from flowing into the recording head by filter D.

The area of the filter chamber C is increased in cross section and the flow rate of ink is reduced in order to enhance the original bubble capture function of the filter and to prevent the increase in flow path resistance that accompanies the insertion of the filter D. However during an ink filling operation or a recovery operation when the flow rate of the ink passing through the filter D is comparatively increased, bubbles on the filter D can not be completely removed and may remain on the surface of the filter D.

When a bubble E is retained on the filter D, it expands during printing until it covers a large area of the filter D. The bubble reduces the area of the filter D through which ink can pass and causes the flow path resistance to become extremely high. When the flow path resistance is high, the supply of ink to the recording head is interrupted, thereby disabling the printing operation.

SUMMARY OF THE INVENTION

To resolve the above problem, it is an object of the present invention to provide an ink-jet recording apparatus that can prevent the stagnation of bubbles at a filter and thereby supply an adequate amount of ink to a recording head.

To achieve the above object, the present invention includes an ink-jet recording head apparatus comprising: a recording head for ejecting ink droplets upon receiving ink transported along a first ink supply path; a second ink supply path along which ink is transferred from an ink cartridge to the first ink supply path; and a filter located in an area connecting the first ink supply path to the second ink supply path, wherein a portion of the connecting area adjacent to the second ink supply path is filled with a porous material so that the front surface of the porous material contacts the filter, and wherein the ink transported along the second ink supply path is introduced to the filter via the porous material.

The entire top surface of the filter is uniformly wetted with ink by the capillary attraction of the porous material, so that the stagnation of bubbles does not occur, and so that bubbles can pass through the filter smoothly.

BRIEF DESCRIPTION OF THE DRAWINGS

The above objects and advantages of the present invention will become more apparent by describing in detail preferred embodiments thereof with reference to the accompanying drawings, in which.

DETAILED DESCRIPTION OF THE PREFERRED EMBODIMENTS

Figure 1:
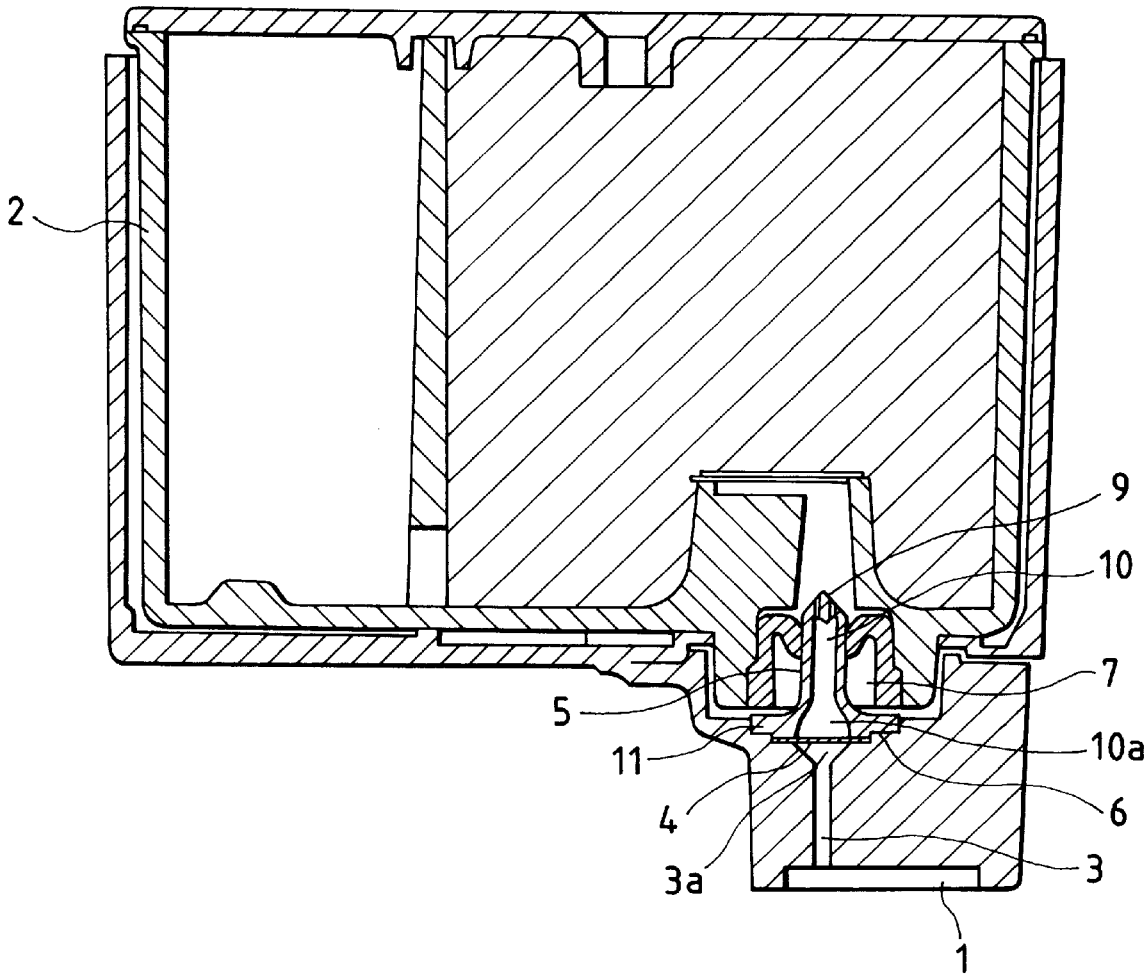
FIG. 1 is a diagram showing an ink supply system in an ink-jet recording apparatus according to the present invention.

The embodiments of the present invention will now be described in detail while referring to the drawings.

In FIG. 1 is shown one embodiment of the present invention. A recording head 1 for ejecting ink droplets in response to print signals is mounted on a carriage (not shown) together with an ink cartridge 2. The recording head 1 ejects ink droplets through nozzle openings as it, along with the carriage, reciprocates across the width of a recording sheet. Further, the recording head 1 receives, from the ink cartridge, ink transported along a first ink supply path 3 in an amount equivalent to that consumed.

An expanded open portion 3*a* is formed at the upstream end of the first ink supply path and communicates on its upstream side with the ink cartridge. The expanded portion 3*a* together with an expanded open portion 10*a* of an ink supply needle 5 define a filter chamber that serves as a link between the first ink supply path 3 for supplying ink to the recording head and a second ink supply path 10 that will be described later. A recessed portion 6 is formed around the expanded open portion 10*a* to hold the filter 4 or in which to embed the ink supply needle 5.

Figure 2:
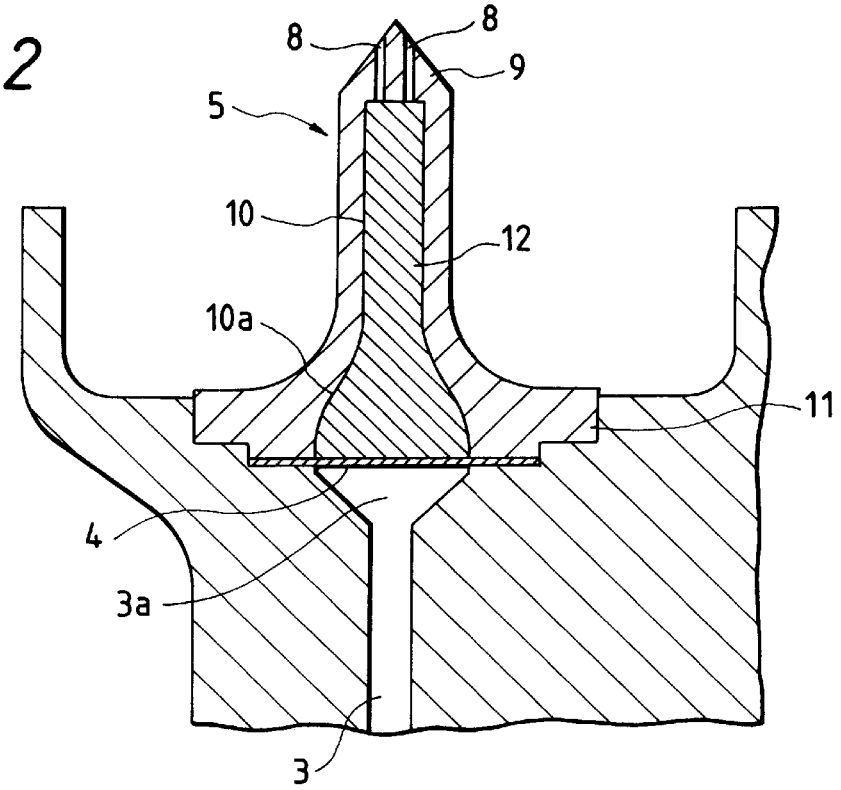
FIG. 2 is an enlarged cross-sectional view of the vicinity of an ink supply needle in the ink supply system.

As shown in FIG. 2, the ink supply needle 5 includes a needle tip 9, which is inserted into an ink supply port 7 of the ink cartridge 2 and which has: an ink guide hole 8 through which ink in the ink cartridge 2 is discharged for transfer to the recording head 1; a hollow portion 10 that defines a second ink supply path; and a flange 11 that is fixed into the recessed portion 6. The expanded open portion 10*a* is formed in the vicinity of the flange to define a filter chamber, together with the expanded open portion 3*a*.

According to the present invention, a porous material 12, such as polyurethane foam, is employed to fill the hollow portion 10 and the expanded open portion 10*a* of the ink supply needle 5. Porous material 12 includes small sequential holes which easily absorb ink, yet is itself ink resistant.

This structure can be provided by first filling the ink supply needle 5 from the needle tip 9 to the expanded open portion 10*a* with the porous material 12, preferably until the material 12 flexibly abuts on the filter 4. The structure is then completed by pressing the flange 11 onto the filter 4 within the recessed portion 6, and thermally welding the flange in place.

In this embodiment, when the needle tip 9 of the ink supply needle 5 is inserted into the ink supply port 7 of the ink cartridge 2, the ink in the ink cartridge 2 is attracted into the distal end of the hollow portion 10 by the capillary attraction of the ink guide hole 8 of the needle tip 9. The ink is then attracted to the filter 4 by the capillary attraction of the porous material 12.

According to the preferred embodiment of the invention, the average pore size of the porous material 12 may be designed to be smaller than the diameter of the ink guide hole 8 and larger than the mesh size of the filter, so that the ink can assuredly flow from the ink guide hole 8 to the filter 4.

When the ink from the ink cartridge 2 reaches the filter 4, the recording head 1 is sealed by a cap member and a negative pressure is applied to the entire flow path. The negative pressure causes the ink in the ink cartridge 2 to flow through the porous material 12 to the recording head 1. Further, the negative pressure causes bubbles, that have stagnated along the flow path extending from the ink cartridge 2 to the nozzle openings, to be discharged together with ink.

When the ink filling process following the replacement of an ink cartridge is completed in this manner, and when a drive signal is transmitted to the recording head 1, ink droplets are ejected from the recording head 1. As the pressure in the recording head is reduced due to the ejection of ink droplets, the ink in the ink cartridge 2 flows to the recording head 1 via the porous material 12 in an amount equal to the volume of the ink that was consumed.

When bubbles that are generated in the ink cartridge flow into the ink supply needle 5, they pass through the porous material 12 and to the filter 4. However, since the upstream surface of the filter 4 contacts the porous material 12 and is constantly wetted with ink, the bubbles can not stagnate there, and instead, smoothly pass through the filter 4 and flow downstream to the expanded open portion 3*a*.

Since the bubbles that flow to the expanded open portion 3*a* have passed through the filter 4, they are extremely small. The cross sectional area of the bubbles is so substantially reduced by the porous material 12 that the flow rate of the ink which passes through the filter is higher than the ink flow rate through the conventional filter chamber that is not filled with the porous material 12. Therefore, when the recording head 1 is sealed by a cap member and the ink is forcibly discharged in order to recover from an ink droplet ejection failure, the bubbles are easily discharged from the flowpath along with the ink.

Figure 3:
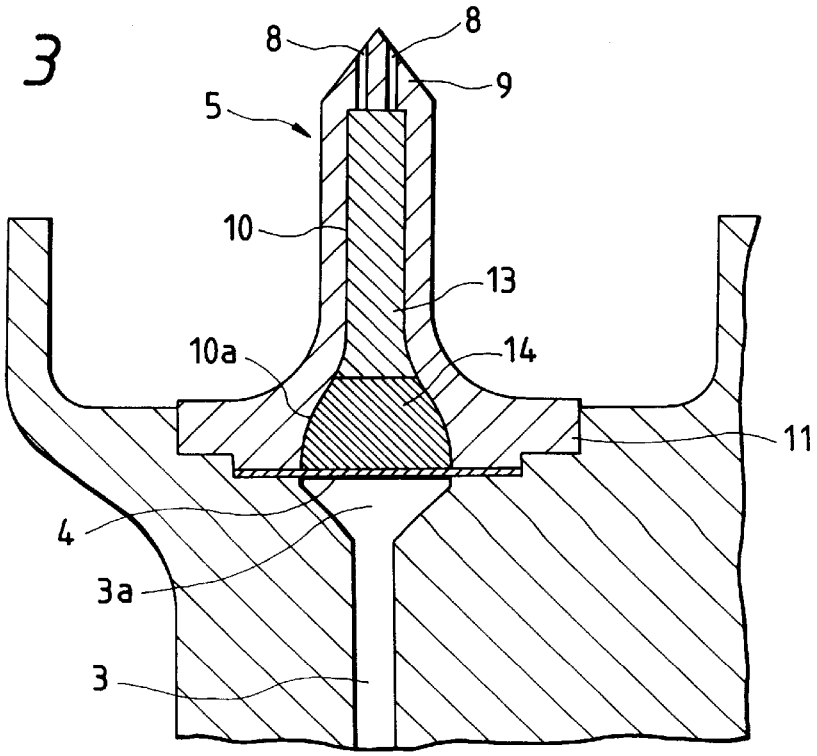
FIG. 3 is an enlarged cross-sectional view of the vicinity of the ink supply needle of another example according to present invention.

In the above described embodiment, only one type of porous material is used to fill the ink supply needle. However, as is shown in FIG. 3, a porous material 13 having a low capillary attraction is used to fill the hollow portion 10 of the ink supply needle 5 closest to the ink cartridge, and a porous material 14 having a large capillary attraction is used to fill the expanded open portion 10*a*. Different capillary attractions can be generated by using porous materials having different pore sizes. In this embodiment, the ink can be conveyed to the filter 4 without its flow being interrupted by negative pressure in the ink cartridge, or by flow path resistance.

When only one type of porous material is employed, the porous material 12 is of such a proportion that it normally extends from the opening of the expanded open portion 10*a*. The normally extending portion is selectively compressed by the filter 4, thereby increasing capillary action near the filter and also improving the contactivity of the filter to the porous material 12.

Further, by improving the hydrophilic property of the porous material 12, the ink can be guided to the filter more assuredly and, as a result thereof, the air bubbles can be prevented from remaining in the porous material 12. For the sake of improving the hydrophilic property of the porous material 12, the porous material 12 may be preferably formed by dispersing particle oxide such as silica, aluminum, titania or the like in the raw porous material such as urethane, or by, after preforming a porous material, the same is treated with amine-series solvent such as 1,3-propane-diamine, 1,5-pentadiamine or the like.

Furthermore, in a case where the ink cartridge will not be removed so that the porous material is exposed to atmospheric air through the ink guide hole thereby drying and solidifying the ink, particularly in a case where the ink cartridge contains special ink or pigment of the ink which is easy to solidify, the porous material disposed in the hollow portion 10 of the ink supply needle 5 at the ink cartridge side may be designed to have a strong capillary force so that the ink holding performance of the porous material 12 at the easy-drying part thereof is strong. Hence, the ink can be suppressed from solidifying due to the drying.

Figure 4:
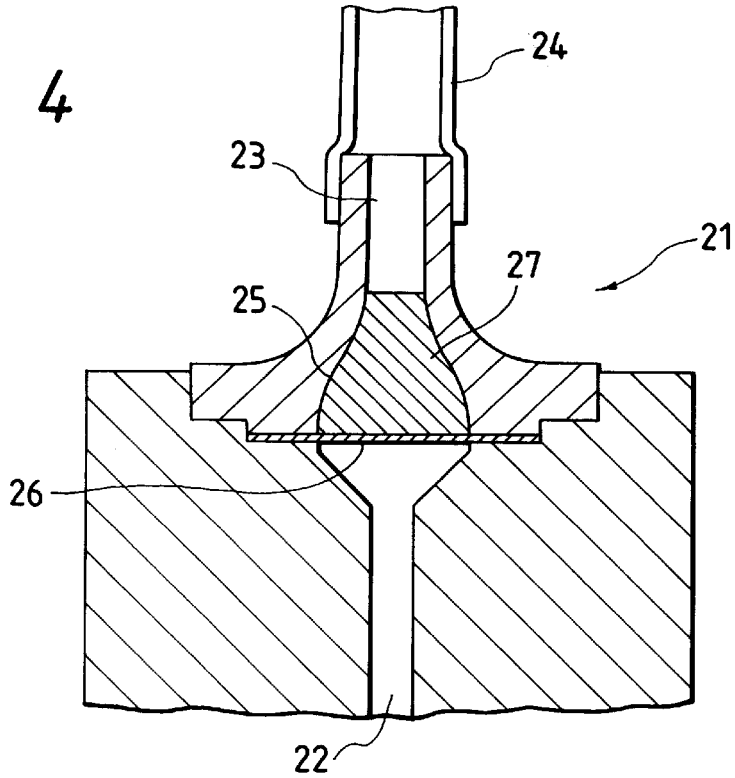
FIG. 4 is an enlarged cross-sectional view of the vicinity of ink supply needle of an example appropriate for a recording apparatus that is connected to an ink cartridge via an ink supply tube.
Figure 5:
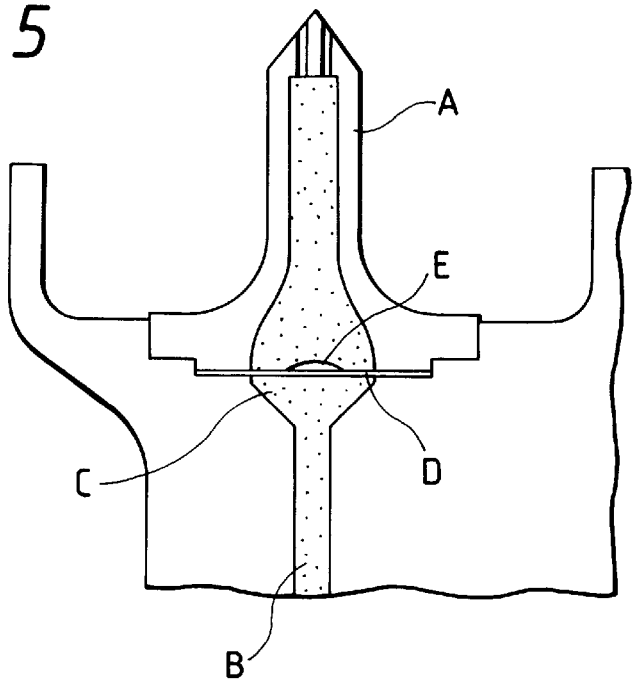
FIG. 5 is a diagram showing the structure near a filter for a conventional ink-jet recording apparatus.

FIG. 4 shows another embodiment wherein a housing of a recording apparatus is provided with an ink cartridge in which ink is supplied to a recording head by an ink supply tube. A filter unit 21, as well as a recording head are mounted on a carriage. A first ink supply path 22, is downstream of the filter unit 21 and communicates with the recording head. A second ink supply path 23 is upstream of the filter unit 21 and communicates with the ink cartridge via an ink supply tube 24.

An expanded open portion 25 is formed in an area connecting the first ink supply path 22 to the second ink supply path 23, and a filter 26 is provided therein. A porous material 27 is used to fill the portion of the connecting area upstream of the filter 26 so that it contacts the filter.

According to the present embodiment, the porous material 27 is filled merely in the expanded open portion 25. Even such arrangement is capable of preventing the air bubbles from remaining on the filter 26. The arrangement may also be applied to the other embodiment which employs the ink supply needle.

As is described above, the present invention, includes an ink-jet recording head apparatus which comprises: a recording head for ejecting ink droplets upon receiving ink transported along a first ink supply path; a second ink supply path along which ink from an ink cartridge is transferred to the first ink supply path; a filter located in an area connecting the first ink supply path to the second ink supply path, and a porous material filling the portion of the connecting area adjacent to the second ink supply path so that the front surface of the porous material contacts the filter and ink carried by the second ink supply path is introduced to the filter via the porous material. In this arrangement, the top surface of the filter is uniformly wetted with ink. Therefore, bubbles do not stagnate on the top surface of the filter, and increase in the flow path resistance due to the expansion of bubbles is prevented.

Even when the ink cartridge is removed, ink can be retained by the capillary attraction of the porous material, therefore the management of the size of the ink guide opening in the needle tip is not required, and the manufacturing procedures can be simplified.

It is contemplated that numerous modifications may be made to the ink-jet recording device of the present invention without departing from the spirit and scope of the invention as defined in the following claims.

What is claimed is:

1. An ink-jet recording apparatus which receives ink from an ink cartridge, comprising:

a recording head for ejecting ink;

a first ink supply path for supplying ink to said recording head;

a second ink supply path along which ink from said ink cartridge is transferred to said first ink supply path;

a third ink supply path along which ink from said ink cartridge is transferred to said second ink supply path, wherein said third ink supply path does not contain a porous material;

a connecting area connecting said first ink supply path to said second ink supply path;

a filter located in said connecting area; and a porous material located in a portion of the ink supply path;

wherein a portion of the connecting area adjacent to the second ink supply path is filled with the porous material so that a front surface of said porous material contacts said filter, and wherein said ink transported along said second ink supply path is introduced to said filter from said porous material.

2. An ink-jet recording apparatus according to claim 1, wherein, said second ink supply path comprises a hollow portion having a first end and a second end opposite said first end, wherein said first end communicates with said first ink supply path and said second end includes a needle tip portion that communicates with said ink cartridge.

3. An ink-jet recording apparatus according to claim 2, wherein said second ink supply path is filled with said porous material from said needle tip portion to said filter.

4. An ink-jet recording apparatus according to claim 2 or 3, wherein said needle tip portion has an ink guide hole formed therein and wherein an average pore size of said porous material is smaller than a diameter of said ink guide hole and larger than a mesh size of said filter.

5. An ink-jet recording apparatus according to claim 3, wherein a capillary force of said porous material is stronger than that of a porous material in said ink cartridge.

6. An ink-jet recording apparatus according to claim 3 or 5, wherein the capillary force of said porous material varies in accordance with the compression rate of said porous material.

7. An ink-jet recording apparatus according to claim 3 or 5, wherein said porous material comprises a plurality of porous material elements having different pore and different capillary forces.

8. An ink-jet recording apparatus according to claim 1, wherein said porous material includes a first porous material having a first capillary attraction and a second porous material having a second porous attraction, wherein said first porous material is adjacent to said filter and said first capillary attraction is larger than said second capillary attraction.

9. An ink-jet recording apparatus according to claim 1 or 8, wherein said porous material is compressed by said filter.

10. An ink-jet recording apparatus according to claim 1, wherein a filter chamber is formed in said connecting area connecting said first ink supply path to said second ink supply path.

11. An ink-jet recording apparatus according to claim 10, wherein said second ink supply path includes a downstream side and wherein said porous material is filled in said downstream side of said second ink supply path.

12. An ink-jet recording apparatus according to claim 1, wherein said porous material is subjected to hydrophilic treatment.

13. An ink-jet recording apparatus according to claim 1 or 12, wherein particle oxide is dispersed in said porous material.

14. An ink jet recording apparatus according to claim 13, wherein said particle oxide is selected from the group consisting of silica, aluminum, and titania.

15. An ink jet recording apparatus according to claim 12, wherein the porous material is treated with an amine-series solvent selected from the group consisting of 1,3-propanediamine and 1,5-pentadiamine.

16. An ink jet recording apparatus according to claim 1, wherein said second ink supply path is detachable with respect to said third ink supply path.

17. An ink jet recording apparatus which receives ink from an ink cartridge comprising:

a recording head for ejecting ink;

an ink supply path for supplying ink from said ink cartridge to said recording head;

a porous material located in a portion of said ink supply path, wherein said portion of the ink supply path is separate from said ink cartridge; and a filter disposed in said ink supply path so as to contact at least a portion of said porous material from a side of said porous material facing said recording head.

18. An ink jet recording apparatus according to claim 17, wherein said porous material comprises first and second porous materials having different capillary attractions so as to promote ink flow to said recording head.

19. An ink jet recording apparatus according to claim 17, wherein said ink supply path further comprises an expanded portion located upstream of said filter, and wherein said porous material is located substantially in said expanded portion.

* * * * *